US010969141B2

(12) United States Patent
Nelson et al.

(10) Patent No.: US 10,969,141 B2
(45) Date of Patent: Apr. 6, 2021

(54) REGULATING TEMPERATURE AND REDUCING BUILDUP IN A WATER HEATING SYSTEM

(71) Applicant: NGB INNOVATIONS LLC, Lynden, WA (US)

(72) Inventors: Robert Norman Nelson, Lynden, WA (US); Daniel James Brown, Kirkland, WA (US); Antony Howard Gaynair, Huntington Beach, CA (US)

(73) Assignee: NGB INNOVATIONS LLC, Lynden, WA (US)

( * ) Notice: Subject to any disclaimer, the term of this patent is extended or adjusted under 35 U.S.C. 154(b) by 330 days.

(21) Appl. No.: 15/919,672

(22) Filed: Mar. 13, 2018

(65) Prior Publication Data

US 2019/0285313 A1 Sep. 19, 2019

(51) Int. Cl.

| | |
|---|---|
| ***F24H 1/10*** | (2006.01) |
| ***F24H 9/18*** | (2006.01) |
| ***F24H 9/20*** | (2006.01) |
| ***F24H 1/20*** | (2006.01) |
| ***F24H 9/00*** | (2006.01) |

(52) U.S. Cl.

CPC ..... *F24H 9/2021* (2013.01); *F24H 1/103* (2013.01); *F24H 1/202* (2013.01); *F24H 9/0042* (2013.01); *F24H 9/0047* (2013.01); *F24H 9/1827* (2013.01)

(58) Field of Classification Search

None

See application file for complete search history.

(56) References Cited

U.S. PATENT DOCUMENTS 4,122,763 A * 10/1978 Waninger ..... A47J 31/0573 340/608

5,601,742 A 2/1997 Yamashita (Continued)

FOREIGN PATENT DOCUMENTS

CN 2876689 Y 3/2007

CN 202928442 U 5/2013

(Continued)

OTHER PUBLICATIONS

Fitzpatrick, Richard, "Boundary Layer on a Flat Plate," Mar. 2016, Univ. of Texas.*

(Continued)

*Primary Examiner* — Joseph M. Pelham

(74) *Attorney, Agent, or Firm* — Sughrue Mion, PLLC

(57) ABSTRACT

A water heating apparatus includes: a water container configured to heat water via a convection process by receiving the water through an inlet and passing water through an outlet; and one positive temperature coefficient (PTC) heating element or a plurality of PTC heating elements arranged within the water container and configured to be immersed during the convection process. The plurality of PTC heating elements have a gap between each PTC heating element. Further, the water heating apparatus includes at least one ultrasonic transducer attached to the water container and configured to project ultrasound onto and around the PTC heating element or the plurality PTC heating elements within the water container and to descale the PTC heating element or the plurality of PTC heating elements.

14 Claims, 5 Drawing Sheets

(56) References Cited

U.S. PATENT DOCUMENTS

| | | | | |
|---|---|---|---|---|
| 5,804,797 | A | 9/1998 | Kaimoto et al. | |
| 5,990,459 | A | 11/1999 | Feustel et al. | |
| 7,503,287 | B2 | 3/2009 | Friedrich | |
| 7,571,674 | B2 | 8/2009 | Wang | |
| 9,927,147 | B2 * | 3/2018 | Wu | H05B 3/24 |
| 2003/0223305 | A1 * | 12/2003 | Halsall | B01F 11/0258 366/127 |
| 2004/0161227 | A1 * | 8/2004 | Baxter | F24H 9/2021 392/454 |
| 2008/0000889 | A1 * | 1/2008 | Niederer | B60H 1/2221 219/205 |
| 2008/0099464 | A1 * | 5/2008 | Niederer | F24H 3/0405 219/520 |
| 2010/0132921 | A1 | 6/2010 | Moskal | |
| 2010/0154819 | A1 * | 6/2010 | Doglioni Majer | A47J 31/60 134/1 |
| 2014/0144607 | A1 | 5/2014 | Furukawa et al. | |
| 2015/0059809 | A1 | 3/2015 | Petri et al. | |
| 2015/0117846 | A1 * | 4/2015 | Kohl | H05B 3/141 392/479 |
| 2016/0282068 | A1 | 9/2016 | Reckner et al. | |
| 2016/0360574 | A1 * | 12/2016 | Bohlender | H05B 3/06 |
| 2017/0130991 | A1 * | 5/2017 | Liu | F24H 9/1827 |
| 2017/0370614 | A1 * | 12/2017 | Liu | F24H 9/1827 |
| 2018/0031271 | A1 * | 2/2018 | Huang | F24H 1/102 |
| 2018/0065447 | A1 * | 3/2018 | Cmelik | F24H 1/009 |
| 2018/0160480 | A1 * | 6/2018 | Bohlender | F24H 1/121 |
| 2018/0319252 | A1 * | 11/2018 | Kohl | H05B 3/50 |
| 2019/0077224 | A1 * | 3/2019 | McCarthy | H05B 3/24 |
| 2020/0166242 | A1 * | 5/2020 | Zoske | B29C 45/0001 |

FOREIGN PATENT DOCUMENTS

| | | | |
|---|---|---|---|
| CN | 104266538 | A | 1/2015 |
| CN | 206432358 | U * | 8/2017 |
| DE | 102 45 824 | B3 | 2/2004 |
| EP | 0 810 836 | A1 | 12/1997 |
| EP | 1 166 698 | A1 | 1/2002 |
| EP | 2 044 869 | A1 | 4/2009 |
| GB | 2 228 634 | A | 8/1990 |
| JP | 2009293889 | A * | 12/2009 |
| WO | 01/06196 | A1 | 1/2001 |
| WO | 2008/155538 | A2 | 12/2008 |
| WO | 2016/153964 | A1 | 9/2016 |

OTHER PUBLICATIONS

International Search Report dated May 17, 2019 in copending International Application No. PCT/US2019/021068.

Written Opinion of the International Searching Authority dated May 17, 2019 in copending International Application No. PCT/US2019/021068.

* cited by examiner

REGULATING TEMPERATURE AND REDUCING BUILDUP IN A WATER HEATING SYSTEM

BACKGROUND

This disclosure relates generally to water heating systems, and more particularly, to electrical water heating systems that regulate temperature and reduce scale buildup on heating elements.

Typically, heat transfer from electrical heating elements to water is predominantly performed by convection, that is, warmer water moves into and mixes with colder water. This mixing can occur in the thermal boundary layer, which is an area of fluid close to a solid surface. Further, the rate of heat transfer is directly proportional to the temperature difference across the thermal boundary layer.

In electrical water heaters at steady-state, the heat transfer rate into the water balances the heat generated by the electricity. When a portion of a heating element becomes dry via a drop in water level or from an air bubble in the incoming water becoming trapped adjacent to the heat element, the heat transfer drops. This results in a localized temperature increase in the element. Steam may be generated where the water contacts the bubble. This too acts as an insulator and inhibits the transfer of heat from the heating element to the water. This causes the temperature of the steam trapped next to the heating element to continue rising. In turn, the increased temperature causes the steam to build pressure. For example, at a temperature of 150° C., steam has a vapor pressure of approximately 5 bar, which is five times that at a temperature of 100° C. As water is predominantly incompressible, every part of the water heating system that may become closed, sealed or blocked may be subject to the rising steam pressure, even if the temperature is much lower in the rest of the heating system.

A conventional water heating system typically utilizes electrical conductors such as nichrome as electrical heating elements. Under resistive heating, the temperature of nichrome can reach upwards of 2000° F. or 1000° C. without melting. However, this temperature is above the critical point of water, where the saturation pressure is 221 bar. It is impractical to build pressure vessels to withstand such extreme pressures. Normal practice is to fit pressure relief valves to limit the maximum pressure that a water heater can experience. These add to the complexity, weight and maintenance needs of the water heater.

Moreover, when scale is deposited onto the surface of heating elements, the scale surface temperature will change little, but the surface roughness, created by the deposited scale, will increase the deposition rate of scale in a vicious circle. As scale is built up, the resulting temperature differential across the scale leads to an increase in element temperature to maintain thermal equilibrium. As electrical resistance in metals tends to increase linearly with temperature, the increased temperature increases its electrical resistance. For example, a temperature increase of 250° C. from 20° C. in copper will double its resistance. The increased resistance will lead to a reduced power output, assuming constant voltage is applied. Thus the effect of scale is to reduce the heat output of the heater. With time, the scale buildup and consequent power reduction may make the heater inoperable. The increased element temperature may also lead to premature failure of the element.

Conventional means for descaling may include flushing a chemical descaler through the water heating system, or opening up the system and physically cleaning the elements, either by brushing or using ultrasound cleaning. Chemical descalers are normally acids that dissolve scale. These acids are corrosive and often toxic. As such, care needs to be taken to ensure that the acids are adequately flushed before returning the heating system to service. Brushing can be effective at removing large scale deposits, but may not remove deposits in inaccessible parts. Lastly, ultrasonic cleaning operates at slower process speeds. Additionally, all of the above mentioned processes require taking the heater offline, which may incur significant disruption and cost.

SUMMARY

In some exemplary embodiments, a water heating apparatus includes: a water container configured to heat water via a convection process by receiving the water through an inlet and passing water through an outlet; and a plurality of positive temperature coefficient (PTC) heating elements, being arranged within the water container and having a gap between each PTC heating element, configured to be immersed during the convection process.

DETAILED DESCRIPTION

Figure 1:
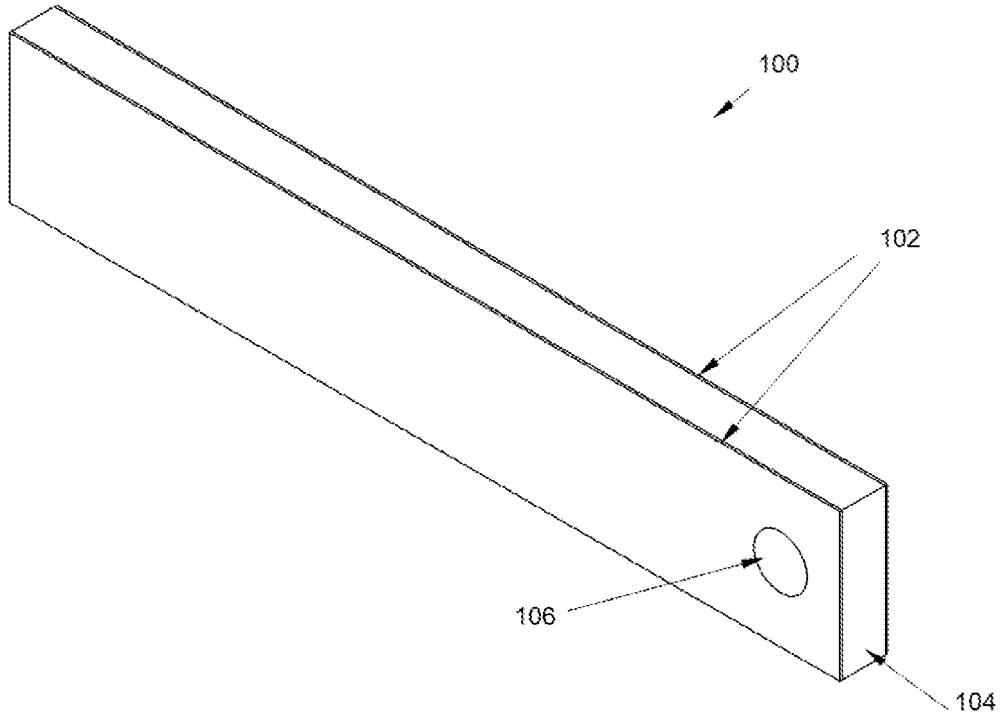
FIG. 1 is an isometric view of a positive temperature coefficient (PTC) element, according to an exemplary embodiment.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Exemplary embodiments of the present disclosure relate generally to water heating systems. Exemplary embodiments that regulate temperature and reduce scale buildup on heating elements are described below with reference to FIGS. 1-3.

FIG. 1 is an isometric view of a Positive Temperature Coefficient (PTC) element 100.

As described in the background, certain hazards arise in standard heating elements when heat is prevented from transferring to the surrounding liquid, thereby causing the heating element's temperature to spike. However, certain ceramic components, such as switching PTC thermistors, may be used to limit the maximum temperature of a heating element by increasing the thermistor's electrical resistance dramatically when a critical temperature is exceeded. By limiting its maximum temperature, the saturation pressure of water or steam trapped next to the PTC heating element can be limited to within the normal operating supply pressures of the heating system.

The PTC heating element 100 can include a PTC thermistor 104 and electrodes 102 secured to opposing sides of the PTC thermistor 104.

The PTC heating element 100 may have a predominantly elongated flat shape and a constant thickness. The electrodes 102 may be made of any electrically-conductive material, for example, aluminum or silver, capable of adhering to the PTC thermistor 104. The electrodes 102 may adhere to the PTC thermistor 104 using a physical vapor deposition process, such as sputtering.

The PTC thermistor 104 may include a doped barium, lead or strontium titanate polycrystalline ceramic or other ceramic having the properties of varying resistance with temperature. The electrical resistance of switching PTC thermistors reduces slightly with temperature up to the point of minimum resistance (TRmin). Above this temperature, it experiences a slight increase in electrical resistance up to the moment it reaches its critical, or Curie temperature (TC). This is normally defined as the temperature where the resistance is double its minimum value. Above the Curie temperature, the resistance can increase by several orders of magnitude within a few degrees increase in temperature. The Curie temperature can be tailored to a given temperature by varying the type and concentration of the material used to dope the ceramic. Further, the barium titanate or other PTC material may also have piezoelectric properties, the benefits of which are discussed in more detail below.

When a voltage source charges the electrodes 102, electricity passes through the thickness of the PTC thermistor 104, thereby heating up the PTC thermistor 104. As water flows over the PTC heating element 100, the resistive heat generated by the PTC thermistor 104 transfers to the surrounding water through convection, thereby heating the water. The electrical power generated is dependent on the element temperature. The balancing heat transfer is dependent on the temperature differential between element and water, the velocity of the water and the geometry of the elements and the gaps between them. Water temperature varies along the length of the element as heat is transferred into it. Thus, the element temperature will vary along the PTC heating element 100, even though a constant voltage is applied to it.

As the electrical resistance is much higher in the ceramic 104 than in the electrodes 102, almost all the thermal power is generated in the ceramic 104 with the electrical current passing through the thickness of the element from one face to the other. As a result, the element acts as an infinite amount of infinitely small resistors, all in parallel with each other. Heat may be transferred to the water through convection from one or both faces. If water is in contact with a single face, the temperature difference across the boundary layer will be significantly greater to balance heat flow. Immersing the element in water, thereby allowing convection on both faces, minimizes the temperature differentials in the boundary layers, thus minimizing the temperature in the element and the maximum localized water temperature for a given total heating power. Immersion of the element is therefore preferred.

The maximum temperature that a PTC element can reach is dependent on the material transporting heat away from it. With more insulation, the rate of thermal loss is lower, so the temperature at which the thermal loss balances the (lower) electrical power is higher. Where the element loses heat by natural convection into air or steam, the maximum surface temperature can be 20° C. greater than the Curie temperature. This provides a natural limit to the element temperature and resulting steam pressure. For example, if the maximum surface temperature of the PTC thermistor 100 is 120° C., the maximum steam pressure can be limited to 2 Bar. That is, the maximum steam pressure that may be generated by the PTC heating element 100 is significantly below the maximum steam pressure that can be generated by standard heating elements, and below the standard water supply pressure. By reducing the maximum steam pressure that can be generated, the water container may use components having a lighter weight than the components in standard water containers, without the need for a pressure relief valve.

The Curie temperature may be varied along the length of an element either by varying the composition of the PTC material or by using smaller elements of different composition positioned adjacent to each other to form a larger element. This may allow the resistance and therefore power of the element to be optimized for the variation in element temperature that results from the change in water temperature along the element, such that the PTC element may be tailored to suit the localized conditions.

It should be noted that this application is not limited to PTC heating elements 100 having an elongated flat shape. Rather this application also contemplates PTC heating elements having different shapes in order to compensate for various water flows and desired temperatures of water as the water flows over the PTC element. For example, a PTC element may be a curved shape having a constant thickness, conical shape, or a shape in which the PTC element is larger on the input side of the water flow and narrower on the output side of the water flow.

To increase the heat transfer density and thus the power per area of the PTC heating element 100, several arrangements, utilizing the PTC heat element 100, to maximize development of the boundary layer will now be described.

It should be noted that the PTC heating elements described in these arrangements may be powered by a single-phase power supply system or a three-phase power supply system in a delta or wye configuration, where different elements are powered by different phases. In particular, the three-phase power system in the wye configuration may be used to increase the line voltage across each PTC heating element 100 increasing the power generated per element and minimizing the number of the elements required.

Figure 2A:
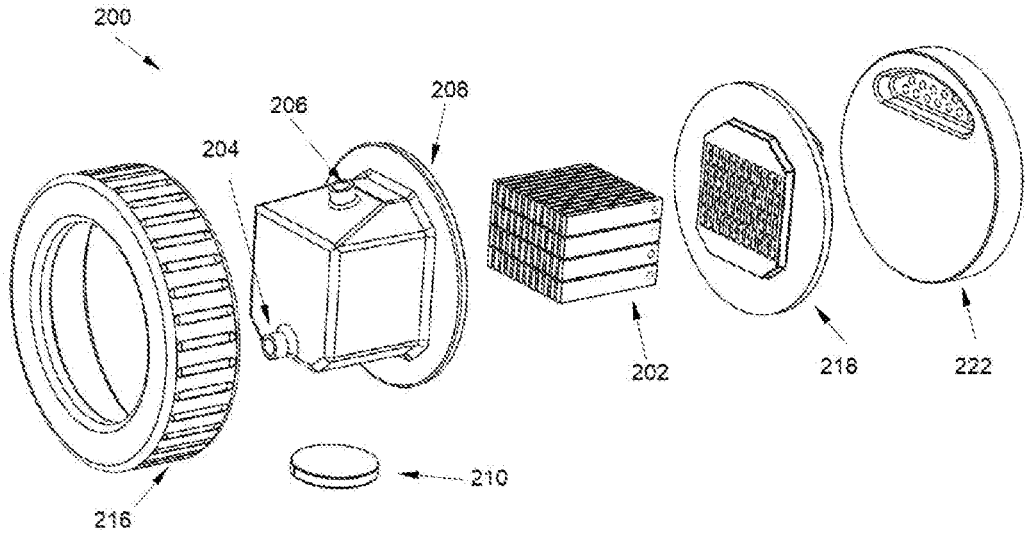
FIG. 2A is an exploded view of a configuration of a water heating apparatus, according to an exemplary embodiment.

FIG. 2A is an exploded view of a configuration of the water heating apparatus 200, functioning as an inline heater.

In this configuration, a plurality of PTC elements 202 is arranged within a water container 208 to support a forced convection process to vary the temperature of the water. An end of each of the PTC elements 202 are positioned within a recess of the gasket 218 such that the end of the PTC element 202 is sealed within the recess. The PTC elements 202 and a portion of the gasket 218 may be inserted into the water container 208. A backing plate 222 and cap 216 may be secured together around the gasket 218 and water container 208 such that the gasket 218 and water container 208 are clamped together and form a water proof seal. The backing plate 222 and cap may be secured to one another in a variety a manners. For example, the backing plate 222 may have an external screw thread around all or a portion of the outer circumference of the backing plate 222, and the cap 216 may have an internal screw thread to receive the external screw thread of the backing plate 222. Further, in another embodiment, a single PTC heating element may be arranged within the water container 208 to support a forced convection process to vary the temperature of the water, similar to that of the above described configuration.

Figure 2B:
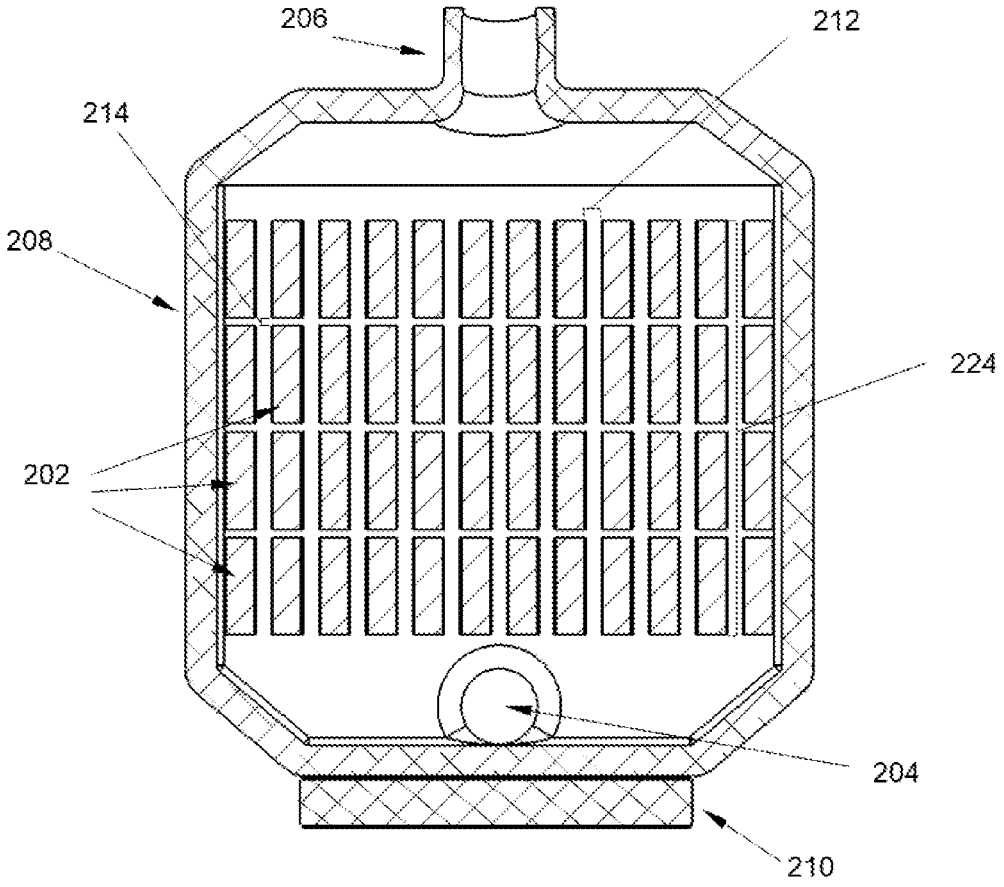
FIG. 2B is a cross-sectional front view of the configuration, according to an exemplary embodiment.

FIG. 2B is a cross-sectional front view of the water heating apparatus 200.

The PTC heating elements 202 may be arranged across the water container 208 such that each of the PTC heating elements 202 are separated by a gap 212. This arrangement allows the power density in the PTC heating elements 202 to be balanced with the heat transfer density into the water. In this configuration, there may also be gaps 214 between adjacent elements in the same row 224. These allow a seal between all four faces of each element 202 with the gasket 218. The gap 214 may be small enough to allow the row of elements 224 to act as a single element, while permitting the use of individual elements with different Curie temperatures within the same element-row 224. The gap 212 between each row of PTC heating elements 202 may be as small as practicable. This reduces the length of an element row 224 needed for the thermal boundary layers to interact and the water temperature to become similar across the gap 212. This also may reduce the peak temperature in the thermal boundary layer. The gap 212 may be 1% of the total length of a row of elements 224. The gap 212 between each PTC heating element 202 or row of PTC heating elements 202 may be less than or equal to $1/15^{th}$ of a length, in the direction of water flow, of the PTC element 202 or row of PTC elements 202, respectively. For the scenarios in which the gap 212 is greater than 1/15th of the total length of a row of elements 224, the element temperature may increase enough to reduce the power generated in the element significantly. For example using PTC elements with a Curie temperature of 110° C., a water heater with input temperature of 20° C. and a flow rate of 0.5 liter/min may heat water to 93° C. when the gap between element rows is 3% of the row length. Purely increasing the gap to 13% of the row length reduces the power of the heater by 50%, resulting in an output temperature of only 59° C. This is as a result of an increase in element temperature from 107° C. to 117° C. A PTC element 202 used in water heating apparatus 200 may be, for example, 35 millimeters (mm) in length, 6 mm in width, and 2 mm in thickness. Where there are four elements in a row 224, the gap 212 between rows of elements 202 may also range between 0.5-1.6 mm. The water heating apparatus may contain, for example, 40-100 PTC elements 202.

Figure 2C:
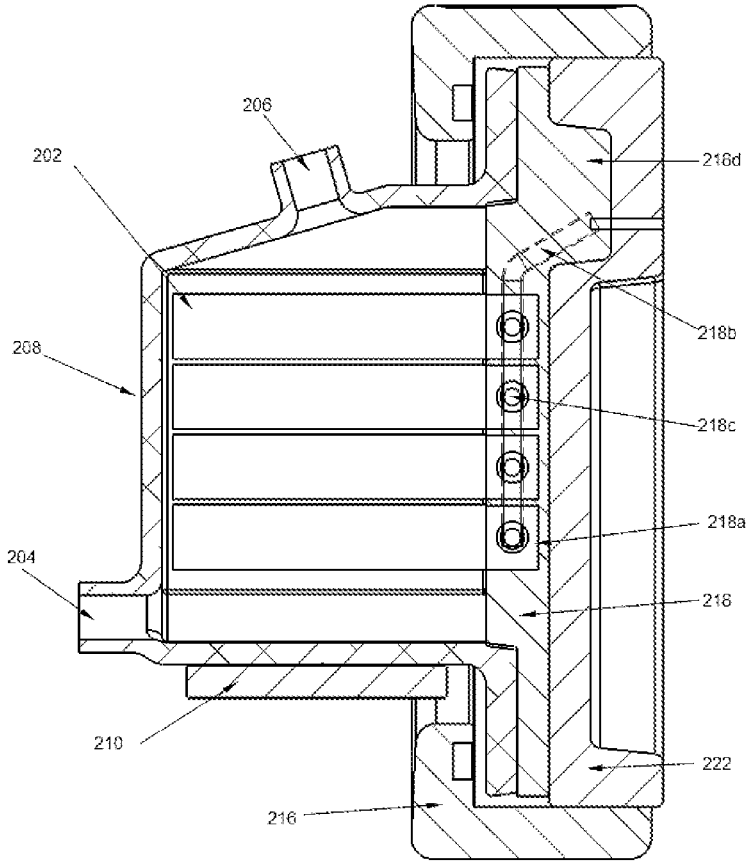
FIG. 2C is a cross-sectional side view of the configuration, according to an exemplary embodiment.

FIG. 2C is the cross-sectional side view of the water heating apparatus 200.

The water container 208 may include an inlet 204 for receiving water and an outlet 206 for passing the water out of the water container 208. The water may pass besides a portion or all the PTC elements 202 as the water travels from the inlet 204 to the outlet 206. To control the water temperature, a pump may vary the flow rate of water from a water source through the water container 208 and over the PTC elements 202. The pump may receive water from the water source and pump the water through the inlet. The pump may be of a positive displacement type, such as a roots pump or a peristaltic pump. The pump may isolate the pressure downstream from the water source, such as a water storage tank or a water main. Increasing the change in temperature may be attained by increasing the number of PTC elements 202, using elements with a higher Curie temperature, or reducing the flow rate of water. During the convection process, when water is forced through the water container 208, the PTC elements 202 may be fully or partially immersed in the water.

The gasket 218 may contain rebates 218*a* to receive PTC elements 202. These may be formed undersized compared with the elements, such that there is an interference fit between gasket and element to produce a seal. Bare electrical wire 218*b* may be embedded in the gasket during its forming, running between each row of elements 202. The gasket provides it electrical insulation. The wires may have conductive pads 218*c* on each side to align with uninsulated patches on the elements 106, allowing electrical connection to them. If a single wire is placed between each row of elements, the electrode 102 is electrically connected with the adjacent electrode of the adjacent element. The wires may be connected together in the grow-out 218*d* to permit all electrodes of a single phase and polarity to be joined together. This is the preferred embodiment, as it results in all of the elements in a row 224 being connected to the same phase. As the temperature will vary between elements in a row, so does their resistance. However, as the temperature in each stage of a row will be similar, their resistances will be similar from row to row. Connecting all the elements in the same row 224 therefore gives similar total resistance for each row, allowing the power to be balanced across phases.

The PTC elements 202 may be centrally positioned in the water container 208. A region upstream of the PTC elements 202 encourages an even flow of water through all of the PTC elements 202. The water container 208 may contain a mesh or perforated plate in the region upstream to even the flow of water and restrict the water's momentum perpendicular to the main flow of water. A region downstream of the PTC elements 202 encourages mixing of the water. The amount of mixing necessary may increase with the increase of the gap 212 between the PTC elements 202, as there may be a greater variation in water temperature across the gap 212 as the size of the gap increases.

In one exemplary embodiment, an ultrasonic transducer 210 may be positioned against the outside of the wall of the water container 208, as further described below. In another exemplary embodiment, the water container 208 may not include an ultrasonic transducer 210.

The PTC heating elements 202 may be electrically insulated. To provide electrical insulation, electrically insulating materials that allow thermal conductivity may be deposited onto the PTC heating elements 202. The electrically insulating material may have a high electrical resistivity to insulate the PTC heating elements 202 from water and a high thermal conductivity to limit the temperature drop across the coating. The material may also be relatively hard to resist erosion from ultrasonic cleaning processes.

The deposition process may include vapor-deposition processes such as a chemical vapor deposition (CVD) or a physical vapor deposition (PVD). The electrically insulating material may include, for example, Aluminum Oxide, Titanium Nitride, diamond, and Diamond Like Carbon coatings (DLCs). Prior to the deposition process, the surface of the PTC element may be polished to reduce surface roughness. The polished surface finish may reduce the rate of scale build-up. In a first example, utilizing a PVD process, a coating of 4-6 micron thickness of alumina may be deposited onto all surfaces of the PTC element. In a second example, utilizing a PVD process, a coating, such as aluminum oxide, may be deposited onto an exposed face of a PTC element, and utilizing a CVD process, a coating, such as DLC, may be deposited to the metallic, electrode faces of the PTC element.

The thickness of the material deposited onto the PTC heating elements 202 may vary based on the resistivity of the coating material. For materials having a high resistivity, such as alumina, the thickness of the material may be 4 microns providing a resistance and dielectric strength sufficient to be an effective insulator. Materials with lower resistivity may require greater thicknesses. By reducing the thickness to the minimum practical range, the temperature drop across the coating's thickness may be reduced due to its thermal conductivity.

Figure 3:
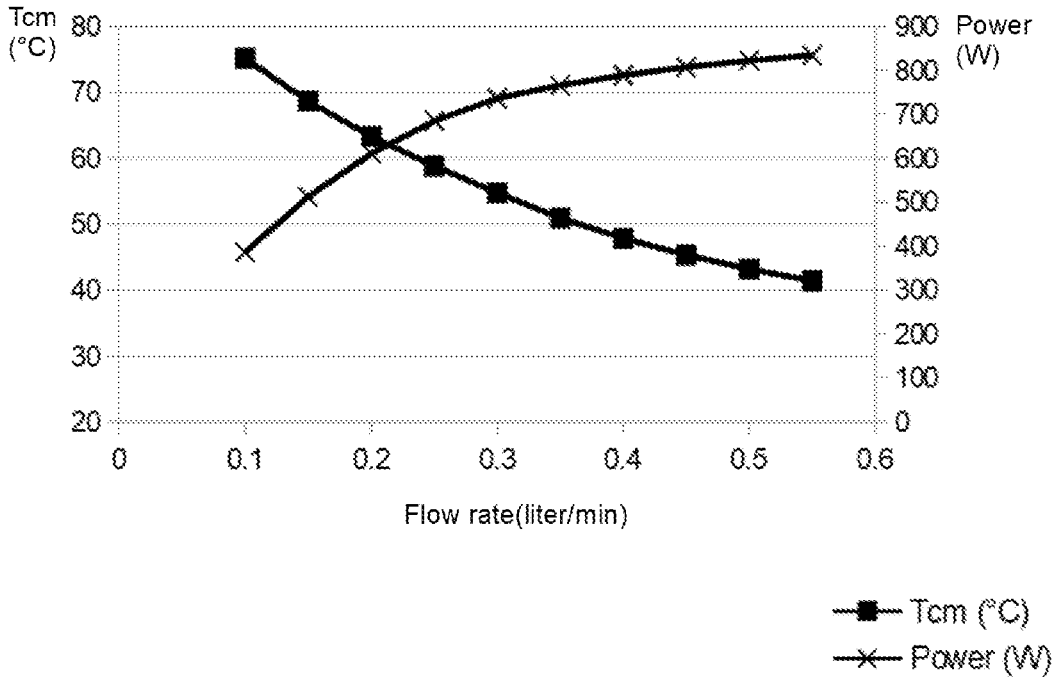
FIG. 3 is a graph illustrating the steady-state cup-mixing delivery temperature (Tcm) and power consumption (W) corresponding to a flow rate (liters/minute) of water through the configuration of the water heating apparatus, according to an exemplary embodiment.

FIG. 3 is a graph illustrating the steady-state cup-mixing delivery temperature (Tcm) and power consumption (W) corresponding to a flow rate (liters/minute) of water through the water heating apparatus 200. Data points of FIG. 3 may be as follows:

| Flow (l/min) | Tem (° C.) | Power (W) |
|---|---|---|
| 0.1 | 75.1 | 386.4 |
| 0.15 | 68.6 | 512.8 |
| 0.2 | 63.3 | 610.6 |
| 0.25 | 58.8 | 684.7 |
| 0.3 | 54.8 | 736.4 |
| 0.35 | 50.9 | 766.0 |
| 0.4 | 47.9 | 788.9 |
| 0.45 | 45.3 | 807.2 |
| 0.5 | 43.2 | 822.2 |
| 0.55 | 41.4 | 834.7 |

Heating water directly using the PTC elements, described in the above mentioned configurations, creates a negative feedback process for reducing the rate of scale buildup. That is, in situations where scale begins to form on the PTC elements, the thermal resistance of the PTC element increases leading to a rise in the temperature of the PTC element and a significant decrease in the local heat generation in the PTC element. Therefore, the outer surface of the scale, as well as the temperature of the water, in the area where the local heat transfer is reduced becomes cooler, and the scale may begin to deposit in warmer areas.

To further inhibit the rate of scale buildup, ultrasonic transducers 210 may be attached to the water container of the above described configuration to bath the PTC elements or single PTC heating element in ultrasound. By having the ultrasonic transducers present within the water heating system, cleaning is a part of the standard operation of the water heating system. A description of the ultrasonic cavitation and cleaning process will now be described.

Ultrasound refers to sound waves at a frequency above the range of human hearing, for example between 25 kHz and 80 kHz. Ultrasonic transducers can be actuated by high frequency electrical inputs to cause a surface to vibrate. This vibration sends pressure pulses through a liquid. With each pulse, an increased pressure is followed by a reduced pressure, as the surface squeezes and stretches the medium. At high enough frequencies and amplitudes, the pressure in the low pressure region of the pulse can drop below the vapor pressure for the liquid. At this point, a cavity of vapor forms in the liquid. These cavitation bubbles tend to be unstable and, when subject to higher pressure, collapse producing a localized shock wave. When this collapse occurs next to a fixed surface, the shock wave can dislodge material that fouls the surface. The energy released when a bubble collapses is proportional to the energy absorbed to create it. At temperatures approaching a liquid's boiling point, little energy is required to form a vapor bubble. Hence, little energy is released or cleaning performed by cavitation collapse near a liquid's boiling point. For example, ultrasonic cleaning is of limited benefit using water at atmospheric pressure when its temperature is 90° C. or higher, which equates to a vapor pressure (saturation pressure) 70% of that at 100° C.

As previously discussed above with respect to FIG. 2, an ultrasonic transducer 210 may be attached to the water container 208. The ultrasonic transducer 210 may be positioned on the bottom of the water container 208 perpendicular to the gap 212 between the PTC elements 202, such that the ultrasound may travel along the length of the PTC elements 202. The ultrasound may also travel onto and around the single PTC element or plurality of PTC elements 202. The ultrasonic transducer 210 may also be positioned on a side wall of the water container 208 perpendicular to a side of the PTC elements 202, such that the ultrasound travels along a width of the PTC elements 202.

The ultrasonic transducer 210 may focus and direct the ultrasound towards the PTC heating elements 202, changing the local liquid pressure around the PTC heating elements 202. Further, due to the reflections off surfaces of the PTC heating elements 202, the ultrasonic transducer 210 may produce a similar intensity across an area of the volume of fluid that is excited by ultrasonic transducer 210.

The ultrasonic transducer 210 can project the ultrasound towards the PTC heating elements 202 at an angle of incidence, for example 90° or less, such that the ultrasound contacts the surface of the PTC heating elements 202. The ultrasonic transducer 210 may emit a flat wave front with constant pressure parallel to the surface of the ultrasonic transducer 210. The flat wave may vary in a direction normal to the surface of the ultrasonic transducer 210. The ultrasonic transducer 210 may also include a phased array of point sources that can send waves with a flat wave front in a plurality of directions.

The angle of incidence of the ultrasonic wave may be the angle between the normal of the incident surface and the direction of the wave front. If a wave is normal to a flat surface of a PTC heating element 202, the whole of the surface may experience the same pressure at the same time. If a wave is oblique to the surface of the PTC heating element 202, the pressure may vary across the surface at any instant.

The ultrasonic transducer 210 can project ultrasound at a range of 25 kHz-80 kHz. The frequency may affect the size of the cavitation bubble. For example, a lower frequency ultrasonic wave may produce a smaller amount of larger, higher-energy bubbles, and a higher frequency ultrasonic wave may produce a larger amount of smaller, lower-energy bubbles. Increasing the power of the transducer increases the number of cavitation bubbles, rather than changing the size of individual bubbles.

The ultrasonic transducer 210 may perform a cleaning operation at various cleaning cycles when the PTC heating elements 202 are submerged in water. For example, the ultrasonic transducer 210 can perform cleaning while the water is flowing and the PTC heating elements 202 are not heating; or while the water is not flowing and the PTC heating elements 202 are not heating. Further, the water heating apparatus 200 may be configured to cycle between heating water and projecting ultrasound when the temperature of water surrounding the plurality of PTC heating elements 202 is cooler than the boiling temperature of the water.

A light cleaning cycle may be performed regularly, occurring between each heating cycle, or every few heating cycles. The light cleaning cycle may be performed while the water is not flowing and at a water temperature at which its saturation pressure is about 75% of the general water pressure or lower. The light cleaning cycle may involve lower power (for instance 25 w), higher frequency (for instance 40 kHz) ultrasound. This is optimized for dislodging small particles while minimizing erosion of the PTC elements 202 by generating fewer, lower-energy bubbles. The smaller number of bubbles may form preferentially at "seed" sites on surfaces having higher local roughness, such as scaled regions.

The light cleaning cycle may start while the heater is cooling down and continue at least until the PTC elements 202 have cooled to inlet water temperature. As the water cools, the solubility of $CaCO_3$ increases significantly. This light cleaning cycle may result in disruption of the scale as it deposits and a more gentle build up in cavitation intensity as the water temperature drops. The dislodged particles may be microscopic and small compared with the dissolved solids from any beverage made using the water flowing through the water container 208, thereby being imperceptible to a consumer.

As the performance of the PTC elements 202 decreases due to the buildup of scale, a more aggressive cleaning cycle may be required to remove larger scale deposits. The more aggressive cleaning cycle may be performed on an as-required basis. This cleaning cycle may use higher-power (for instance 100 w), lower frequency (for instance 25 kHz) ultrasound, which is optimized for dislodging larger particles of scale. This cleaning cycle may be performed on unheated water to maximize the effectiveness of the cleaning, and may utilize water flowing through the water container 208 to carry the larger particles outside of the water container 208. The water used during this cleaning cycle may be discharged via the outlet 206. The water used during this cleaning cycle may also not be used in the creation of beverages. The water may be pumped into a drain system, a reservoir, or a receptacle for the water based on the use of the water heating apparatus 200.

In another exemplary embodiment, the water heating apparatus 200 may not include a dedicated ultrasonic transducer. Rather, the PTC elements 202, utilizing the piezoelectric properties of the barium titanate or other such material, may perform a self-cleaning operation. An alternating current may pass through the PTC elements 202 at ultrasonic frequencies causing the PTC elements 202 to vibrate. Based on the vibration and small gap 212 between the PTC elements 202, a relatively small deflection in the PTC elements 202 may result in a significant expansion and contraction in the water, producing cavitation and therefore allowing the PTC elements 202 to perform a self-cleaning operation. These self-cleaning PTC elements 202 may be secured to the gasket 218 on one side of container 208 and a flexible gasket on the opposite side of the water container 208, allowing the PTC elements 202 freedom to vibrate but restraining the net movement of the PTC elements 202.

In another exemplary embodiment, the amount of cleaning for the deep cleaning cycles described above may be detected. As scaling develops, the PTC element temperature either locally or globally increases. This results in an increase in the PTC element's electrical resistance. Measuring the resistance gives a means of indicating the amount of fouling present and hence the amount of cleaning required. It also presents a means of provoking a power cut-off, if the resistance increases above a certain value. For instance, the power density of the PTC elements may be 100 $kW/m^2$, and the thermal conductivity of scale may be 1.2 W/m/° C. Assuming a thickness of scale of 0.2 mm, the temperature drop across the scale is: (100 $kW/m^2$)×(0.0002 m)/(1.2 W/m/° C.)=16.6° C. For an element with reference temperature of 110° C., the element resistance is 1000 Ohms. A 10° C. increase in temperature at the reference temperature may increase the resistance by a factor of 10 to $10^4$ Ohms. The above described configurations and type of PTC elements may be optimized to keep the PTC elements near their Curie temperature. Any increase in temperature in the PTC element due to the presence of scale may have a significant and easily detectable effect on the total electrical resistance and the power consumed in the complete water heater.

In another exemplary embodiment, the presence of scale may also be detected by measuring the pressure generated by the constriction of water flow between the gap 212 of the PTC elements 202. For instance, 0.2 mm of scale over PTC elements 202 may result in a narrowing of the gaps 212 from 1 mm to 0.6 mm. By using a positive displacement pump to move the water, the constriction, generated by the narrowing of the gap 212, may result in a significant and measurable increase in pressure before the constriction that would be required to maintain the same flow rate. The water heating apparatus may be configured to monitor the water pressure between the positive displacement pump and the PTC elements 202, in which the water pressure may be used to indicate the level of scaling on the PTC elements, and to control an amount of ultrasonic cleaning required.

When an amount of scale is detected, the more aggressive cleaning cycle may be initiated. The cycle may be repeated between each heating operation until the level a scale drops below a certain level. The scale levels may be defined based on the level of accuracy in detecting a drop in performance of the heating operation. For instance, an ammeter may be used for each phase of the voltage source, and a pressure sensor may be positioned between the pump and the PTC elements 202. The resistance of the PTC elements 202 can be determined from the current, detected by the ammeter, and supply voltage. The resistance can be compared to the pressure readings detected by the pressure sensor. A controller may determine that the aggressive cleaning is required when the resistance and pressure readings have a comparable deviation from the nominal measurements of the system.

For the cases in which the PTC elements 202 become dry, either through the water level dropping and exposing an element or excessive air bubbles becoming trapped on the PTC elements 202, the water heating apparatus 200 may shutoff power to the PTC elements 202. The water heating apparatus 200, via the ammeter, may detect a portion of the PTC elements 202 are overheating when the current drops below a certain value. In the event of the system failing to shutdown, a design is envisaged accounting for the maximum possible temperature of PTC elements 202 and any applicable safety factors, in which the heater housing and associated plumbing is designed to resist the maximum steam pressure possible that can be generated by the PTC element.

Although the subject matter has been described in terms of exemplary embodiments, it is not limited thereto. Rather, the appended claims should be construed broadly, to include other variants and embodiments, which may be made by those skilled in the art without departing from the scope and range of equivalents of the subject matter.

What is claimed is:

1. A water heating apparatus comprising:

a water container configured to heat water via a forced convection process by receiving the water through an inlet and passing water through an outlet; and a plurality of positive temperature coefficient (PTC) heating elements arranged within the water container and configured to be immersed during the forced convection process, wherein the plurality of PTC heating elements have a gap between each pair of adjacent PTC heating elements, and wherein the gap is less than or equal to $1/15^{th}$ of a length, in a direction of water flow, of one PTC heating element, or one of rows of the PTC heating elements, respectively.

2. The water heating apparatus of claim 1, wherein at least one of the PTC heating elements comprises an elongated flat or curved shape, having a constant thickness.

3. The water heating apparatus of claim 2, wherein the at least one of the PTC heating elements is coated with an electrical insulating material.

4. The water heating apparatus of claim 2, wherein the plurality of PTC heating elements being arranged side by side, having the gap in between each of the PTC heating elements, or the rows of the PTC heating elements, across the water container.

5. The water heating apparatus of claim 4, wherein ones of the PTC heating elements in at least the one of the rows of the PTC heating elements have different Curie temperatures.

6. The water heating apparatus of claim 1, further comprising at least one ultrasonic transducer attached to the water container and configured to project ultrasound onto and around at least one of the PTC heating elements within the water container and to descale the at least one of the PTC heating elements.

7. The water heating apparatus of claim 6, wherein the at least one ultrasonic transducer is further configured to project ultrasound at an angle of incidence to the at least one of the PTC heating elements, and wherein the angle of incidence is an acute angle with respect to a plane formed by largest surfaces of the at least one of the PTC heating elements.

8. The water heating apparatus of claim 6, wherein the water heating apparatus is configured to cycle between heating water and projecting ultrasound at a water temperature at which its saturation pressure is 75% or lower of water pressure.

9. The water heating apparatus of claim 1, wherein the PTC heating elements, which are naturally piezoelectric, are configured to be powered at ultrasonic frequencies to act as a transducer and perform a self-cleaning operation.

10. The water heating apparatus of claim 1, wherein the water heating apparatus is further configured to monitor an electrical resistance of the PTC heating elements and to control an amount of ultrasonic cleaning required, the electrical resistance indicating a level of scaling on the PTC heating elements.

11. The water heating apparatus of claim 10, wherein the water heating apparatus is further configured to use the monitored electrical resistance to determine an overheating of the PTC heating elements and to order a shut off of power to the PTC heating elements.

12. The water heating apparatus of claim 1, wherein the water heating apparatus is further configured to monitor the water pressure between a pump with a known flow rate and the PTC heating elements to indicate the resistance to flow and hence the level of scaling on the PTC heating elements and to control an amount of ultrasonic cleaning required.

13. The water heating apparatus of claim 1, wherein at least one of the PTC heating elements is arranged adjacent to an inner wall of the water container, and wherein a gap between the at least one of the PTC heating elements and the inner wall is less than or equal to $1/15^{th}$ of the length.

14. A water heating apparatus comprising:

a water container configured to heat water via a forced convection process by receiving the water through an inlet and passing water through an outlet; and at least one PTC heating element is arranged within the water container and is configured to be immersed during the forced convection process, wherein the at least one PTC heating element is arranged adjacent to an inner wall of the water container, and wherein a gap between the at least one PTC heating element and the inner wall is less than or equal to $1/15^{th}$ of a length, in a direction of water flow, of the at least one PTC heating element.

* * * * *